US006563413B1

(12) United States Patent
Ponweiser et al.

(10) Patent No.: US 6,563,413 B1
(45) Date of Patent: May 13, 2003

(54) MULTIPLE PARALLEL CONDUCTOR FOR ELECTRICAL MACHINES AND DEVICES

(75) Inventors: Johann Ponweiser, Erlach (AT); Gernot Schnaubelt, Pernitz (AT)

(73) Assignee: Asta Elektrodraht GmbH, Oed (AT)

( * ) Notice: Subject to any disclaimer, the term of this patent is extended or adjusted under 35 U.S.C. 154(b) by 0 days.

(21) Appl. No.: 09/600,877

(22) PCT Filed: Jan. 21, 1999

(86) PCT No.: PCT/AT99/00014

§ 371 (c)(1),
(2), (4) Date: Aug. 11, 2000

(87) PCT Pub. No.: WO99/44209

PCT Pub. Date: Sep. 2, 1999

(30) Foreign Application Priority Data

Feb. 24, 1998 (AT) ..... 328/98

(51) Int. Cl.[7] ..... H01F 27/28

(52) U.S. Cl. ..... 336/186; 336/61; 336/180; 174/120 R

(58) Field of Search ..... 336/61, 180, 186; 174/120 R

(56) References Cited

U.S. PATENT DOCUMENTS 3,098,113 A 7/1963 Brierley
3,202,558 A * 8/1965 Gottung et al. ..... 174/120 R
3,723,797 A * 3/1973 Anderson et al. ..... 310/196
4,403,163 A * 9/1983 Armerding ..... 310/213
5,464,949 A * 11/1995 Markovitz et al. ..... 174/120 R
5,540,969 A * 7/1996 Schuler ..... 428/248
5,962,945 A * 10/1999 Krenzer et al. ..... 310/208
6,051,793 A * 4/2000 Byrne et al. ..... 174/120 R

FOREIGN PATENT DOCUMENTS

| | | |
|---|---|---|
| DE | 541636 | 1/1932 |
| DE | 19609260 | 9/1997 |
| FR | 2609571 | 7/1988 |
| GB | 1103764 | 2/1968 |
| WO | 95/30991 | 11/1995 |

* cited by examiner

*Primary Examiner*—Lincoln Donovan
*Assistant Examiner*—Tuyen T. Nguyen
(74) *Attorney, Agent, or Firm*—Greenblum & Bernstein, P.L.C.

(57) ABSTRACT

Multiple parallel conductor for an electrical machine and process. The conductor includes a plurality of adjacent subconductors combined to form a subconductor bundle having an outer surface with a plurality of contiguous surface sections arranged in a longitudinal direction, and a flat protective insulation covering at least one of the plurality of surface sections. At least one of the plurality of surface sections remains uncovered by the flat protective insulation covering. A mesh sheathing further covers the plurality of surface sections.

21 Claims, 3 Drawing Sheets

MULTIPLE PARALLEL CONDUCTOR FOR ELECTRICAL MACHINES AND DEVICES

CROSS-REFERENCE TO RELATED APPLICATIONS

This is a U.S. National Stage Application of International Application No. PCT/AT99/00014 filed Jan. 21, 1999 and claims priority under 35 U.S.C. §119 of Austrian Patent Application No. A 328/98, filed on Feb. 24, 1998.

BACKGROUND OF THE INVENTION

1. Field of the Invention

The present invention relates to a multiple parallel conductor for an electrical machine, especially for a transformer, comprising of a plurality of adjacent, preferably mutually insulated subconductors which are combined to form a bundle, and a method for producing such a multiple parallel conductor. Furthermore, the present invention relates to a winding for an electrical machine, especially a transformer comprising a higher-voltage and a lower-voltage winding, comprising of at least one multiple parallel conductor of the abovementioned type, wherein successive windings of the multiple parallel conductor or parallel-wound multiple parallel conductors are arranged axially and/or radially adjacently.

2. Discussion of Background Information

To improve the cooling of electrical conductors, multiple parallel conductors comprising a mesh-shaped wrapping are known. For example, a multiple parallel conductor consisting of a plurality of subconductors or transposed conductors which is taped with a wide-meshed woven ribbon or meshed ribbon of polyester or a glass-filament/polyester mixture having a mesh-size of at least 2 mm is described in International Publication WO95/30991 of the applicant. If necessary, the multiple parallel conductor and/or the woven or meshed ribbon is also impregnated with a partially crosslinked epoxy resin. Such a woven ribbon can be used for producing a solid compact conductor in which the subconductors are in direct contact with the cooling medium. Due to these greatly improved cooling characteristics, a more compact and cost-effective construction of electrical machines and devices becomes possible. If a multiple parallel conductor of this type is processed in such a manner that individual windings or parallel-wound multiple parallel conductors lie directly against one another, there is a risk that the enamel insulation of the subconductors becomes damaged due to friction and that this impairs the electrical characteristics of the winding. For this reason, a multiple parallel conductor of this type is processed in practice in such a manner that spacers are arranged between two adjacent multiple parallel conductors.

Furthermore, from U.S. Pat. No. 3,098,113, an electrical conductor is known which is surrounded completely by a major insulation which can be impregnated with oil and a partial insulation which is impermeable to liquid, to enable impregnation with oil but at least partially to prevent penetration by water. The partial insulation impermeable to liquid, in turn, is provided with a sheathing which can be impregnated with oil. Having regard to a compact and solid conductor, this type of design is disadvantageous since it requires double and triple insulating layers at least in sections. Furthermore, this conductor is characterized by comparatively poor cooling characteristics.

SUMMARY OF THE INVENTION

It is an aspect of the present invention to find a possibility, by further development of multiple parallel conductors of the type mentioned above, of creating windings having an even higher space factor, in which impairment of the electrical characteristics can be avoided and, nevertheless, good cooling characteristics are achieved. Furthermore, it is an aspect of the invention to specify a method for producing such a multiple parallel conductor and to create a possibility for producing windings comprising of at least one such multiple parallel conductor.

On the basis of the abovementioned multiple parallel conductor, this aspect is achieved, according to the invention, in that above the outer surfaces of the subconductor bundle, a flat protective insulation is provided which covers at least one surface section of the subconductor bundle and does not cover at least one further surface section of the subconductor bundle, the surface sections being arranged next to one another referred to the longitudinal direction of the multiple parallel conductor, and that thereabove a mesh-shaped sheathing, e.g. a meshed ribbon, a filament braiding or the like, is provided at least in sections. In a method of the type according to the invention, it is accordingly provided that a flat protective insulation covering at least one side surface but not the entire circumference of the subconductor bundle is placed onto the subconductor bundle and that the subconductor bundle together with the protective insulation is provided with a mesh-shaped sheathing. According to the invention, a winding comprising of at least one multiple parallel conductor according to the invention, in which successive windings of the multiple parallel conductor or parallel-wound multiple parallel conductors are arranged axially and/or radially adjacently, is characterized by the fact that at least one side face of the side faces, facing one another, of adjacent winding sections of the multiple parallel conductor is provided with flat protective insulation. In an embodiment of the winding according to the invention having a particularly high space factor, the side faces provided with a flat protective insulation are in direct contact with one another.

Due to the combination of a protective insulation with a mesh-shaped sheathing, both increased mechanical strength and higher dielectric strength are achieved, so that the individual multiple parallel conductors of a winding can be arranged directly above one another or next to one another without interposition of spacers, and without impairing the electrical characteristics. Due to the free accessibility of the surfaces, which are not in contact with one another, of the multiple parallel conductor to the cooling medium and the good cooling characteristics of a multiple parallel conductor provided with a mesh-shaped sheathing, adequate cooling of the conductor or, respectively, of the winding is ensured. The space factor and, consequently, the production costs for a winding can thus be further reduced, and the operational reliability further increased, by this solution according to the invention.

In a preferred embodiment of the multiple parallel conductor according to the invention, the protective insulation comprises one or more side faces and the edge areas, facing this side face or these side faces, respectively, of the adjacent side faces not provided with protective insulation and, if necessary, the edge areas between adjacent side faces provided with protective insulation. This provides for increased protection of the conductor in the area of the edges so that the dielectric strength can be further increased.

In a winding in which adjacent multiple parallel conductors are in contact with one another over two side faces, e.g. in a group of four, the protective insulation preferably covers at least two adjacent side faces of the multiple parallel conductor in order to provide for all-round protection of the multiple parallel conductor.

The flat protective insulation is preferably paper insulation which, due to its good insulation characteristics and the small space requirement, is excellently suitable for the purposes of the present invention.

A multiple parallel conductor for an electrical machine includes a plurality of adjacent subconductors combined to form a subconductor bundle having an outer surface with a plurality of contiguous surface sections arranged in a longitudinal direction, and a flat protective insulation covering at least one of the plurality of surface sections. At least one of the plurality of surface sections remains uncovered by the flat protective insulation covering. A mesh sheathing further covers the plurality of surface sections.

According to a feature of the invention, the electrical machine can be a transformer. Further, the subconductors may each be mutually insulated. The plurality of contiguous surface sections may have flat surfaces. Further, the mesh sheathing may include meshed ribbon or filament braiding. Moreover, the protective insulation covers a plurality of adjacent surface sections of the plurality of surface sections.

In accordance with another feature of the invention, the flat protective insulation can include an insulation material impregnated with oil. Further, the insulation material may include paper insulation. The subconductors can be enameled insulated.

The present invention is directed to a method for producing a multiple parallel conductor for an electrical machine that includes combining individual subconductors to form a subconductor bundle having a plurality of surface sections, positioning a flat sheet of protective insulation substantially near the outer surface of the subconductor bundle to cover at least one surface section, but not an entire circumference of the subconductor bundle, and covering the subconductor bundle and the protective insulation with a mesh-shaped sheathing.

According to a feature of the invention, the protective insulation may include an insulating material impregnated with oil. Further, the insulating material may include paper.

The protective insulation can be bonded to the subconductor bundle.

The present invention is directed to a winding for an electrical machine that includes a plurality of multiple parallel conductors including a plurality of adjacent subconductors combined to form a subconductor bundle having an outer surface with a plurality of contiguous surface sections. A flat sheet of protective insulation covers at least one of the plurality of surface sections. At least one of the plurality of surface sections remains uncovered by the flat protective insulation covering. A mesh sheathing covers the plurality of surface sections. Successive windings of the multi-parallel conductors are arranged at least one of axially and radially adjacent each other, such that at least one side face of adjacent side faces is covered with the protective insulation.

According to a feature of the present invention, the at least one side of the plurality of surface sections covered by the flat protective insulation of each bundle are arranged so that they face each other with respect to the interfaces formed between the plurality of multiple parallel conductors.

The present invention is directed to a transformer that includes a higher voltage winding and a lower voltage winding. Each winding includes a plurality of multiple parallel conductors having a plurality of adjacent subconductors combined to form a subconductor bundle having an outer surface with a plurality of contiguous sides. A flat sheet of protective insulation covers at least one of the plurality of contiguous sides. At least one of the plurality of adjacent sides remains uncovered by the flat protective insulation covering. A mesh sheathing further covers the plurality of contiguous sides. The plurality of multiple parallel conductors are arranged contiguous to each other, and a top surface of the lower voltage winding facing an interface between adjacent the higher voltage winding and the lower voltage winding includes the protective insulation.

The present invention is directed to a multiple parallel conductor for an electrical machine including a plurality of insulated subconductors combined together to form a bundle. The bundle is formed with a plurality of flat sides contiguously connected to enclose the plurality of insulated subconductors. A flat protective insulation sheet enclosed within the bundle, is positioned substantially near an outer perimeter of the bundle, and covers at least one of the plurality of flat sides of the bundle. A mesh-shaped sheathing covers the bundle.

In accordance with a feature of the present invention, the plurality of subconductors can have rectangular-shaped cross-sections. Moreover, the plurality of subconductors can be positioned adjacent to each other and stacked upon each other to form an array or matrix in regards to the positioning of the plurality of subconductors within the bundle. Further, the plurality of subconductors are arranged in an array or matrix comprising rows and columns. The row can include at least two subconductors adjacent to each other, the columns can include at least two subconductors stacked upon each other. The matrix further may include a top row that includes at least one subconductor offset with respect to half the width of each subconductor, so that the at least one subconductor is positioned on top of the interface between the columns of the matrix.

The present invention is directed to a winding for an electrical machine that includes a plurality of multiple conductors having a plurality of insulated subconductors combined together to form a bundle. The bundle is formed with a plurality of flat sides contiguously connected to enclose the plurality of insulated subconductors. A flat protective insulation sheet enclosed within the bundle is positioned substantially near an outer perimeter of the bundle, and covers at least one of the plurality of flat sides of the bundle. At least one of the plurality of flat sides remains uncovered by the flat protective insulation. A mesh-shaped sheathing covers the bundle. The plurality of multiple conductors are arranged at least one of stacked upon each other, and arranged side by side, to form an array or matrix.

According to a feature of the invention, the flat protective insulation sheet enclosed within each bundle is arranged to be positioned on the flat sides of the bundles which form the interfaces between the array of matrix.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
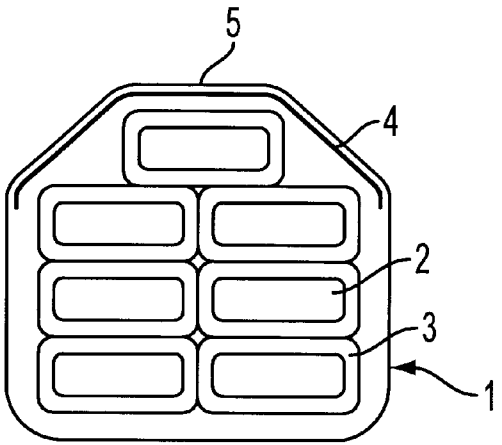
FIG. 1 shows a multiple parallel conductor according to the invention comprising protective insulation on the top.

In the text which follows, reference is made to FIG. 1 in which a multiple parallel conductor 1 for an electrical machine is shown using the example of a transposed conductor for the lower-voltage winding of a transformer. The multiple parallel conductor exhibits a number of subconductors 2, e.g. flat copper conductors having a rectangular cross section.

Each subconductor 2 is provided with insulation 3, in the present case an enamel coating. To manufacture the multiple parallel conductor, the individual subconductors 2 are combined in the required number and alignment to form a subconductor bundle.

In the present illustrative embodiment, protective insulation 4 which covers the entire top and the edge areas of the side faces facing this top is arranged on the top of the subconductor bundle. The side faces and the underside of the subconductor bundle remain without protective insulation. The material selected for the protective insulation is insulating material which can be impregnated with oil, preferably paper, in the required quality and thickness.

To achieve the required solidity, the arrangement of the subconductor bundle with the protective insulation is wrapped with a wide-meshed ribbon 5. Further information relating to the meshed ribbon 5 can be found in the International Application WO95/30991 of the applicant quoted at the start, which must be expressly considered as part of the present disclosure.

In the context of the present invention, all other means for stabilizing a subconductor bundle which are known to the person skilled in the art and in which the cooling medium is in direct contact with at least one side face of the subconductor bundle can naturally be used instead of the above-mentioned meshed ribbon 5, e.g. cross-sheathing with filaments.

Figure 2:
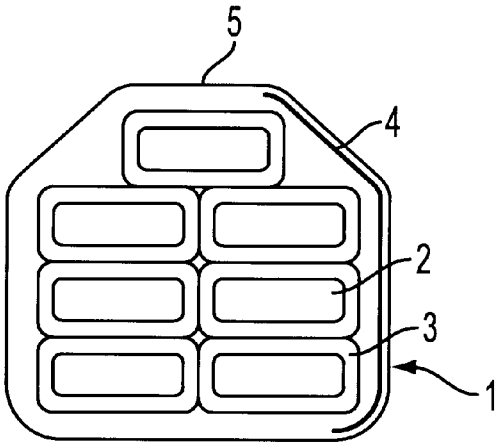
FIG. 2 shows a multiple parallel conductor according to the invention comprising protective side insulation.
Figure 3:
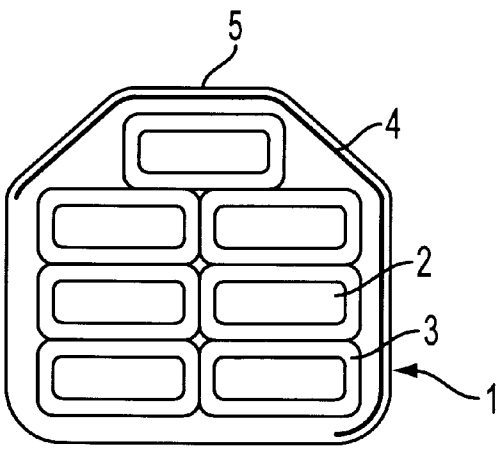
FIG. 3 shows a multiple parallel conductor according to the invention comprising L-shaped protective insulation.

FIGS. 2 and 3 show further illustrative embodiments of the multiple parallel conductor according to the invention, by a transposed conductor for the lower-voltage or medium-voltage winding of a transformer. In the description following, identical reference symbols are used for the same features and these are no longer expressly explained.

In the multiple parallel conductor 1 of FIG. 2, the protective insulation 4 is arranged on one side face and a part-section of the top facing this side face, this protective insulation preferably also extending over the adjoining edge areas. The remaining section of the top, the underside and the opposite side face are without protective insulation.

In the illustrative embodiment of a multiple parallel conductor 1 according to the invention and according to FIG. 3, the protective insulation 4 extends over one side face and the entire top of the multiple parallel conductor 1, wherein again the adjoining edge areas are preferably also enclosed. The opposite side face and the underside remain without protective insulation.

The arrangement of the protective insulation according to the illustrative embodiments described above is not restrictive. Within the scope of the present invention, protective insulation can be arranged at any place and extend over any surface sections. Within the scope of the present invention, it is only provided that the protective insulation extends over at least one surface section (side face, top, underside) and leaves at least one surface section exposed.

Within the scope of the present invention, two or more protective insulations can also be provided which, for example, can be arranged diametrically opposite or adjoining one another.

Figure 4A:
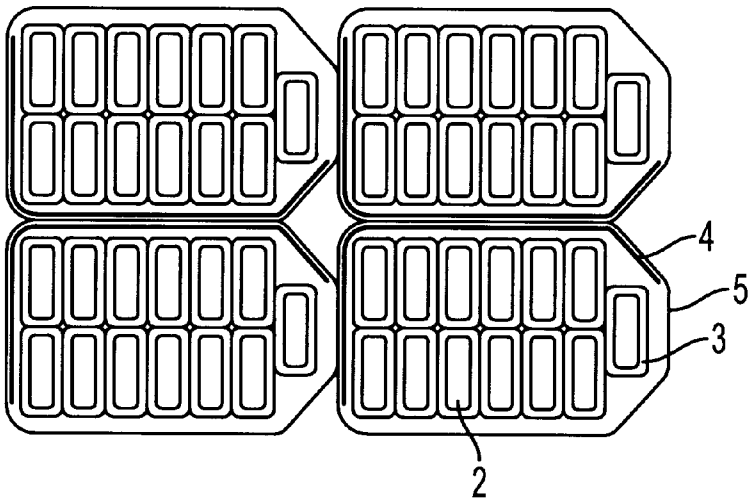
FIGS. 4*a*, 4*b* show a winding of the type according to the invention, in which individual windings of the multiple parallel conductor or of parallel-wound multiple parallel conductors are axially and/or radially adjoining.

In a variant of the embodiment of a winding according to the invention, shown in FIG. 4*a*, the side faces, which are in contact with one another, of two or more multiple parallel conductors 1 are each provided with protective insulation 4 in order to further increase the dielectric strength of the winding.

In another winding, not shown, the multiple parallel conductors can also be arranged directly to one another in a radial direction offset by 90°, instead of in the axial direction. In this case, the protective insulation is arranged at the vertical boundary faces between the individual windings of the radial winding.

Figure 4B:
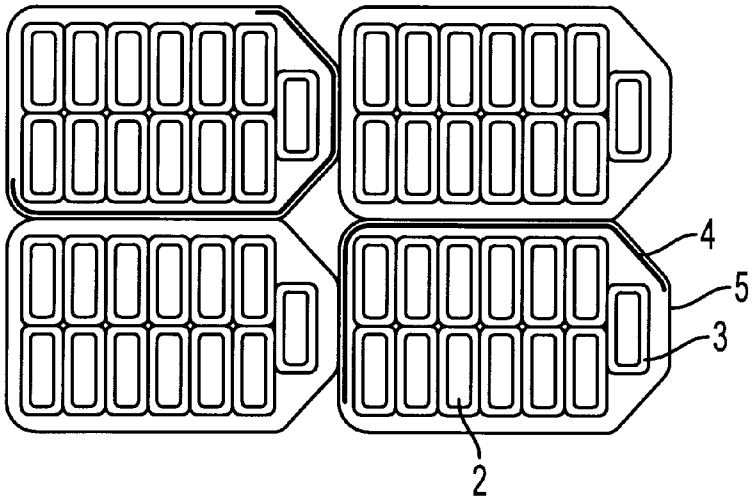

In a variant of the embodiment of a winding according to the invention, shown in FIG. 4*b*, only a part of the side faces, which are in contact with one another, of two or more multiple parallel conductors is provided with a flat protective insulation 4.

Figure 5:
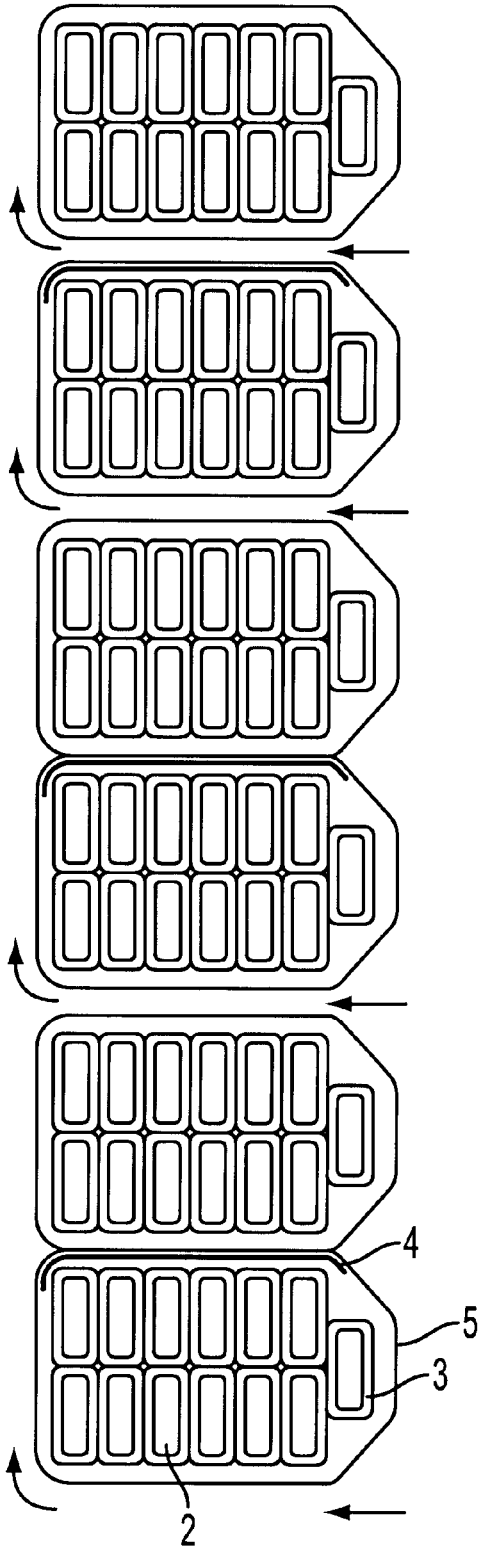
FIG. 5 shows a winding of the type according to the invention, in which individual windings of the multiple parallel conductor or of parallel-wound multiple parallel conductors are axially directly adjoining via a part of the winding but are spaced apart in the remaining part.

FIG. 5 shows a winding 6 for a transformer which is produced by a multiple parallel conductor 7 which is constructed as a so-called transposed conductor, which consists of a large number of subconductors 2.

In the illustrative embodiment shown, the individual windings of the multiple parallel conductor 7 are arranged above one another in the axial direction, a number of windings being directly in contact with one another and a number of windings being spaced apart by means of spacers (not shown) in order to be able to construct between the windings cooling channels for the cooling medium, e.g. oil, which are shown by means of arrows in FIG. 5.

The multiple parallel conductors 7 constructed in accordance with the invention are arranged in such a manner that at least one multiple parallel conductor 7 is provided with protective insulation 4 at least at one of the horizontal boundary faces via which the individual windings are directly in contact with one another.

Naturally, such multiple parallel conductors 7 which are not in direct contact with adjacent windings can also be equipped with protective insulation 4 according to the present invention in order to increase the mechanical rigidity and the dielectric strength of the multiple parallel conductor. Such a multiple parallel conductor is shown at the top in FIG. 5.

Within the context of the present invention, multiple parallel conductors can also be wound together both in the radial and in the axial direction, e.g. in groups of four (FIGS. 4*a*, 4*b*). In this case, an L-shaped protective insulation is preferably provided (see also FIG. 3) which extends both over a horizontal side face and a vertical side face of each multiple parallel conductor.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A multiple parallel conductor for an electrical machine comprising:

a plurality of adjacent subconductors arranged in plural adjacent layers to form a subconductor bundle, said bundle having an outer peripheral surface including a plurality of contiguous surface sections;

a flat protective insulation extending over a portion of the outer peripheral surface of said bundle and covering at least one of the plurality of contiguous surface sections, wherein at least one of the plurality of contiguous surface sections remains uncovered by the flat protective insulation; and a mesh sheathing covering the plurality of contiguous surface sections and the flat protective insulation, wherein the mesh sheathing facilitates adequate cooling of the adjacent subconductors.

2. The multiple parallel conductor according to claim 1, wherein the multiple parallel conductor is adapted for use in a transformer.

3. The multiple parallel conductor according to claim 1, wherein each of the plurality of subconductors is covered with a separate insulation covering.

4. The multiple parallel conductor according to claim 1, wherein each of the plurality of contiguous surface sections includes a planar portion.

5. The multiple parallel conductor according to claim 1, wherein the mesh sheathing comprises one of meshed ribbon or filament braiding.

6. The multiple parallel conductor according to claim 1, wherein the flat protective insulation covers plural adjacent surface sections of the plurality of contiguous surface sections.

7. The multiple parallel conductor according to claim 1, wherein the flat protective insulation comprises an insulation material impregnated with oil.

8. The multiple parallel conductor according to claim 7, wherein the insulation material comprises paper insulation.

9. The multiple parallel conductor according to claim 1, wherein each of the plurality of subconductors is covered with enamel insulation.

10. A winding for an electrical machine comprising:

a plurality of multiple parallel conductors, each of the multiple parallel conductors including a plurality of adjacent subconductors arranged in plural adjacent layers to form a subconductor bundle, said bundle having an outer peripheral surface including a plurality of contiguous surface sections;

a flat protective insulation extending over a portion of the outer peripheral surface of said bundle and covering at least one of the plurality of contiguous surface sections, wherein at least one of the plurality of contiguous surface sections remains uncovered by the flat protective insulation; and a mesh sheathing covering the plurality of contiguous surface sections and the flat protective insulation;

wherein said plurality of multiple parallel conductors are arranged adjacent to one another, such that at least one side face of a multiple parallel conductor which faces an adjacent multiple parallel conductor is covered with the flat protective insulation, and wherein the mesh sheathing facilitates adequate cooling of the multiple parallel conductors.

11. The winding according to claim 10, wherein each side face of adjacent multiple parallel conductors which face one another are covered with the flat protective insulation.

12. Windings for a transformer which includes a higher voltage winding and a lower voltage winding, said windings each comprising:

a plurality of multiple parallel conductors, each of the multiple parallel conductors including a plurality of adjacent subconductors arranged in plural adjacent layers to form a subconductor bundle, said bundle having an outer peripheral surface including a plurality of contiguous surface sections;

a flat protective insulation extending over a portion of the outer peripheral surface of said bundle and covering at least one of the plurality of contiguous surface sections, wherein at least one of the plurality of contiguous surface sections remains uncovered by the flat protective insulation; and a mesh sheathing covering the plurality of contiguous surface sections and the flat protective insulation;

wherein said plurality of multiple parallel conductors are arranged adjacent to one another, such that surfaces of the multiple parallel conductors of the lower voltage winding which face the multiple parallel conductors of the higher voltage winding are covered with the flat protective insulation, and wherein the mesh sheathing facilitates adequate cooling of the multiple parallel conductors.

13. A multiple parallel conductor for an electrical machine comprising:

at least two subconductor bundles positioned adjacent to one another, wherein each of said at least two subconductor bundles includes a plurality of adjacent insulated subconductors arranged in plural adjacent layers, a plurality of contiguous flat sides defining an outer perimeter of each bundle, and a mesh sheathing covering the outer perimeter of each bundle; and a flat protective insulation sheet positioned outside of said outer perimeter of at least one of said bundles to insulate a flat side of the at least one of said bundles from an adjacent flat side of an adjacent bundle, wherein the mesh sheathing facilitates adequate cooling of the adjacent insulated subconductors.

14. The multiple parallel conductor according to claim 13, wherein said plurality of subconductors have rectangular-shaped cross-sections.

15. The multiple parallel conductor according to claim 13, wherein said plurality of subconductors are positioned within said bundles adjacent to one another and stacked upon one another in layers to form a matrix.

16. A winding for an electrical machine comprising:

a plurality of multiple parallel conductors, each multiple parallel conductor including at least two subconductor bundles positioned adjacent to one another, wherein each of said at least two subconductor bundles includes a plurality of adjacent insulated subconductors arranged in plural adjacent layers, a plurality of contiguous flat sides defining an outer perimeter of each bundle, and a mesh sheathing covering the outer perimeter of each bundle; and a flat protective insulation sheet positioned outside of said outer perimeter of at least one of said bundles to insulate a flat side of the at least one of said bundles from an adjacent flat side of an adjacent bundle;

wherein said plurality of multiple parallel conductors are positioned adjacent to one another and stacked upon one another to form an matrix, and wherein the mesh sheathing facilitates adequate cooling of the multiple parallel conductors.

17. The winding for an electrical machine according to claim 16, wherein said flat protective insulation sheet is arranged to be positioned on said flat sides of said bundles which face adjacent multiple parallel conductors of the matrix.

18. A multiple parallel conductor for an electrical machine comprising:

at least two subconductor bundles positioned adjacent to one another, wherein each of said at least two subconductor bundles includes a plurality of adjacent insulated subconductors arranged in plural adjacent layers, a plurality of contiguous flat sides defining an outer perimeter of each bundle, and a mesh sheathing covering the outer perimeter of each bundle; and a flat protective insulation sheet positioned outside of said outer perimeter of at least one of said bundles to insulate a flat side of the at least one of said bundles from an adjacent flat side of an adjacent bundle;

wherein said plurality of subconductors are positioned within said bundles in a matrix comprising plural rows and plural columns, each of the rows including at least two subconductors adjacent to one another, and each of the columns including at least two subconductors stacked upon one another;

the matrix further including a top row that includes at least one subconductor offset with respect to half a width of each subconductor, so that said at least one subconductor is positioned on top of an interface between the columns of the matrix, wherein the mesh sheathing facilitates adequate cooling of the adjacent insulated subconductors.

19. A multiple parallel conductor for an electrical machine comprising:

a plurality of adjacent subconductors arranged to form a subconductor bundle, said bundle having an outer peripheral surface including a plurality of contiguous surface sections arranged in a longitudinal direction; and a flat protective insulation covering at least one of the plurality of contiguous surface sections;

said multiple parallel conductor including plural side faces;

said flat protective insulation extending over at least one of (a) an entire side face of at least one of the plural side faces of the multiple parallel conductor and (b) over edge regions of adjacent side faces of the multiple parallel conductor, wherein at least one of the plurality of contiguous surface sections remains uncovered by the flat protective insulation; and a mesh sheathing covering said bundle, wherein the mesh sheathing facilitates adequate cooling of the adjacent subconductors.

20. The multiple parallel conductor according to claim 19, wherein the mesh sheathing covers the plurality of contiguous surface sections and the flat protective insulation.

21. The multiple parallel conductor according to claim 19, wherein the flat protective insulation extends over at least two of the plural side faces of the multiple parallel conductor.

* * * * *